United States Patent [19]

Ivanov et al.

[11] 4,245,791

[45] Jan. 20, 1981

[54] DEVICE FOR MOUNTING THE BREAKING CONE OF AN INERTIA CRUSHER

[76] Inventors: Nikolai A. Ivanov, Novoizmailovsky prospekt, 19, kv. 96; Boris G. Ivanov, Basseinaya ulitsa, 5, kv. 8; Leonid P. Zarogatsky, Uglovoi pereulok, 5, kv. 21; Evgeny S. Mitrofanov, ulitsa Kibalchicha, 4, korpus 1, kv. 17; Vladimir A. Cherkassky, ulitsa Rudneva, 3, korpus 1, kv. 38, all of Leningrad, U.S.S.R.

[21] Appl. No.: 42,875

[22] Filed: May 29, 1979

[51] Int. Cl.[3] ..... B02C 2/04

[52] U.S. Cl. ..... 241/207; 241/210

[58] Field of Search ..... 241/207–216

[56] References Cited

U.S. PATENT DOCUMENTS

| | | | |
|---|---|---|---|
| 1,553,333 | 9/1925 | Sholl et al. | 241/210 |
| 3,908,916 | 9/1975 | Klushantsev et al. | 241/210 UX |
| 4,073,446 | 2/1978 | Rundkuist et al. | 241/207 |

FOREIGN PATENT DOCUMENTS

| | | |
|---|---|---|
| 419240 | 3/1974 | U.S.S.R. . |
| 497049 | 12/1975 | U.S.S.R. . |

*Primary Examiner*—Howard N. Goldberg

*Attorney, Agent, or Firm*—Lackenbach, Lilling & Siegel

[57] ABSTRACT

A device for mounting the breaking cone of an inertia crusher having a crushing bowl and a breaking cone arranged within the crushing bowl comprises a shell, the top portion of which contains a spherical support provided with a central cylindrical hole to receive a shaft of the breaking cone, and in the bottom portion thereof, there is arranged a ball spindle interconnected with a bush carrying an out-of-balance weight on the outer surface thereof intended for placing the breaking cone shaft therewithin. The bush is of such a length that its upper end is disposed in the central cylindrical hole and enters it so far that the bush rests, when tilted, upon the wall of the central cylindrical hole. Also, an annular projection in the bottom portion of the shell serves as a support for the out-of-balance weight when the bush rests upon the wall of the cylindrical hole.

4 Claims, 3 Drawing Figures

DEVICE FOR MOUNTING THE BREAKING CONE OF AN INERTIA CRUSHER

FIELD OF THE INVENTION

The present invention relates to inertia cone crushers, and more particularly to devices for mounting the breaking cone of an inertia crusher.

The present invention can be most advantageously used in the chemical and ore-dressing industries.

BACKGROUND OF THE INVENTION

Presently, it is known to use inertia cone crushers comprising a crushing bowl and a breaking cone accommodated therewithin to provide an annular breaking cavity. The breaking cone is mounted on a spherical support secured, as is the crushing bowl, to the crusher base. The breaking cone has its shaft seated in a bearing bush provided with an out-of-balance weight on the outer surface thereof. The bush is interconnected with a ball spindle arranged in the bottom portion of the crusher.

In the course of operation, the armour clothing the breaking cone becomes wornout and, therefore, must be repaired or be replaced. Due to design features of the crusher, it is necessary in order to replace the armour of the breaking cone, to remove the latter from the crusher. However, the mounting of the breaking cone into the crusher involves difficulties associated with stopping the bush in a position near to the vertical.

Known in the prior art is a device for mounting the the breaking cone of an inertia crusher having a crushing bowl which accommodates a breaking cone (cf. USSR Inventor's Certificate No. 497,049). The device comprises a shell accommodating a spherical support mounted in the top portion thereof and it is provided with a central hole to receive a breaking cone shaft passing therethrough. In the bottom portion of the shell, there is mounted a ball spindle interconnected with a bush carrying an out-of-balance weight outside thereof and intended for placing the breaking cone shaft therewithin. In said design, the ball spindle is both a drive and a support of the bush.

To mount the breaking cone, one must bring the bush to a vertical position with the aid of a crane and stop it with respect to the crusher shell with three ropes located at 120° to each other and fastened with their loose ends to the shell. The cone is lowered by the crane to let its shaft just enter the crater of the bush. The ropes are then removed from the crusher and the cone is further lowered down to rest upon the spherical support.

However, the mounting of the breaking cone in the device in question, is a time-consuming process which requires subsidiary equipment.

There is also known a device for mounting the breaking cone of an inertia crusher having a crushing bowl (cf. USSR Inventor's Certificate No. 419,240). The device comprises a shell, in the top portion of which there is mounted a spherical support provided with a central hole to receive a breaking cone shaft passing therethrough, and in the bottom portion thereof, there is mounted a ball spindle interconnected with a bush carrying an out-of-balance weight outside thereof intended for placing the breaking cone shaft therewithin.

As distinguished from the device described hereinabove, wherein the ball spindle is both a drive and a support of the bush provided with an out-of-balance weight, in the construction under consideration the spindle operates as but a drive, and a rod with a thrust bearing serves as a support. The rod is disposed inside the breaking cone shaft and is rigidly mounted in its top.

To mount the breaking cone, the rod is stopped by three stops in the vertical position and the cone is lowered by means of a crane until the top end of the rod enters the opening of the cone shaft. The rod therewith functions as a guide for the shaft inserted in the opening of the bush. The stops are then removed and the cone is lowered down to rest upon the spherical support. The entire cone shaft therewith enters the bush. With screwing a nut on a shank of the rod, the bush with the out-of-balance weight is raised to the operating position.

In said crusher, the mounting of the breaking cone is less labor-consuming as compared with the prior art devices described hereinabove, since there is no arduous operation of slinging the bush, but a much easier operation of stopping the rod.

However, this construction, too, features lost time since prior to dismantling of the breaking cone, it is necessary to remove a protective head from it and also a nut securing the rod and to perform the opposite sequence when mounting the cone.

Also known in the art is an inertia cone crusher having a crushing bowl which accommodates a breaking cone (U.S. Pat. No. 4,073,446). The construction is known to comprise a shell, in the top portion of which there is mounted a spherical support provided with a central hole to receive a breaking cone shaft passing therethrough, and in the bottom portion there is mounted a ball spindle interconnected with a bush carrying an out-of-balance weight on the outer surface thereof intended for placing the breaking cone shaft therewithin.

In this crusher, a lateral port of the shell casing is opened prior to dismantling the breaking cone and a cantilever having two support guides for the out-of-balance weight is fastened to the walls of the port. Upon removal of the breaking cone from the crusher, the bush with the out-of-balance weight retains its initial position on the support guides, therefore the subsequent mounting of the cone does not present any difficulties.

However, in this crusher, too, the additional operation of mounting and dismantling the supporting cantilever is retained, which also results in additional time for the mounting of the cone. Moreover, the assembling works remain labor-consuming.

SUMMARY OF THE INVENTION

It is an object of the present invention to simplify the assembling of a crusher when mounting the breaking cone.

Another object of the present invention is to exclude lost time when mounting the breaking cone.

Still another object of the present invention is to cut the labor-consumption of the assembling works when mounting the breaking cone.

With these and other objects in view, there is provided a device for mounting the breaking cone of an inertia crusher having a crushing bowl which accommodates a breaking cone. The device comprises a shell having a spherical support mounted in the top portion thereof and the support is provided with a central cylindrical hole to receive a breaking cone shaft which is passed therethrough in the bottom portion of the shell, there is arranged a ball spindle interconnected with a bush carrying an out-of-balance weight on the outer surface thereof intended for placing the breaking cone shaft therewithin. The bush is of such a length that its upper end is disposed in the central cylindrical hole of the spherical support and enters it so far that the bush rests, when tilted, upon the wall of the central cylindrical hole. An annular projection is provided in the bottom portion of the shell and serves as a support for the out-of-balance weight when the bush rests upon the wall of the cylindrical hole.

The advantage of the proposed device resides in the feature that an easy mounting of the cone in the crusher is possible without the need for subsidiary mechanisms, since stopping the bush with the out-of-balance weight relative to the shell in a position suitable to assemble the shell is obtainable.

It is desirable that the annular projection be shaped as a taper washer facing with its inner tapered surface the out-of-balance weight.

Such an embodiment of the annular projection ensures minimizing, when tilting the bush, its minimal vertical lowering at the instant the bush pivotes about the two hinges of the ball spindle, since, in such a situation, there is no possibility for the lower end of the out-of-balance weight to slip from the projection.

BRIEF DESCRIPTION OF THE DRAWINGS

The present invention will now be explained by the detailed description of the preferred embodiment with reference to the accompanying drawings, in which.

DETAILED DESCRIPTION OF THE INVENTION

Figure 1:
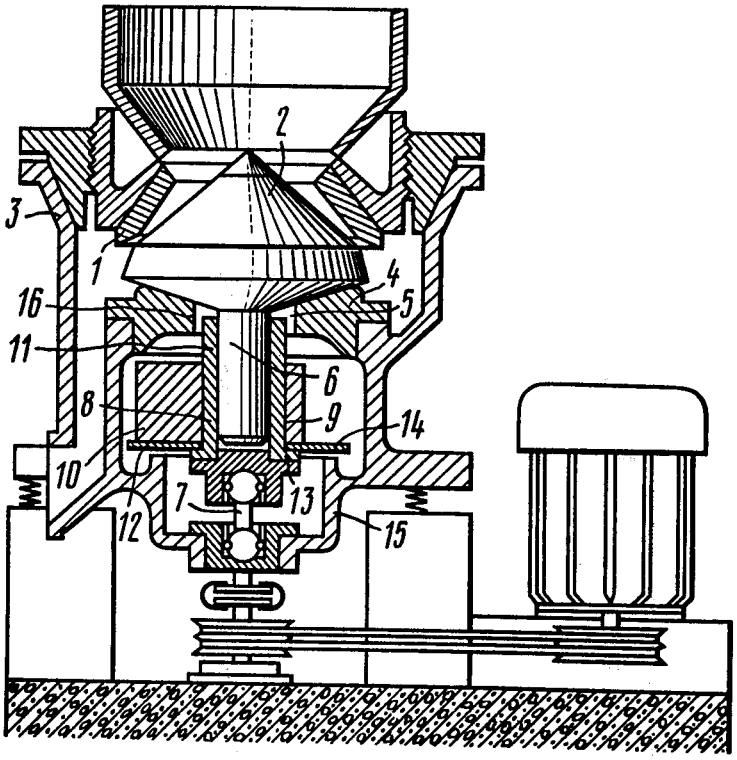
FIG. 1 is a sectional view, taken longitudinally and illustating an inertia crusher, wherein the device for mounting the breaking cone is made according to the invention.
Figure 2:
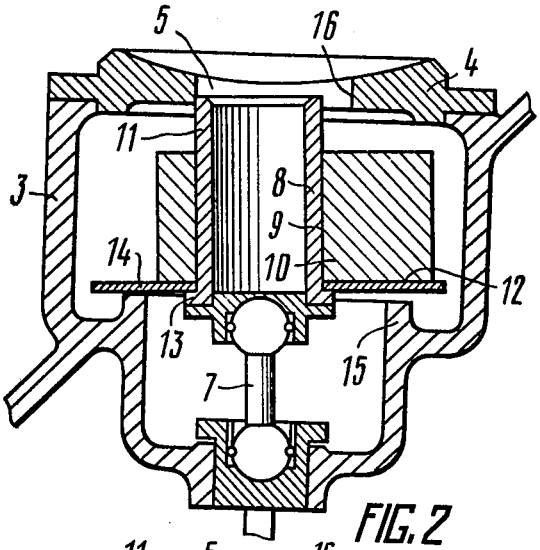
FIG. 2 is a view sectional of a device for mounting the breaking cone of an inertia crusher, according to the invention.
Figure 3:
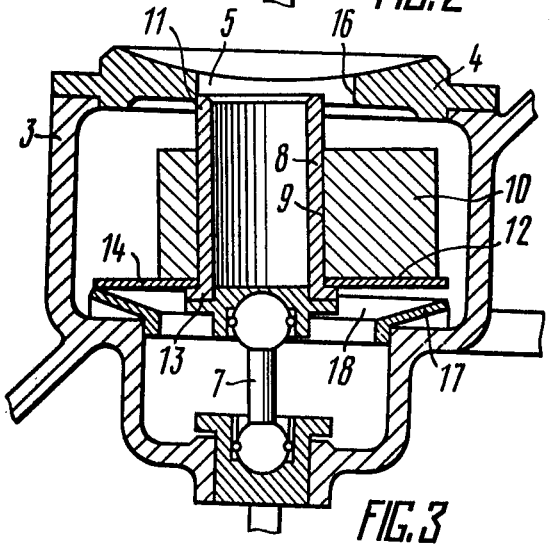
FIG. 3 is a modification of the device for mounting the breaking cone of an inertia crusher, wherein the annular projection is fashioned as a taper washer.

The device for mounting the breaking cone of an inertia crusher has a crushing bowl 1 (FIG. 1) and a breaking cone 2 accomodated therewithin. The device comprises a shell 3 (FIG. 2), in the top portion of which there is mounted a spherical support 4 provided with a central cylindrical hole 5 to receive a shaft 6 of the breaking cone 2. In the bottom portion there is mounted a ball spindle 7 interconnected with a bush 8 carrying on the outer surface 9 an out-of-balance weight 10 intended for placing the shaft 6 of the breaking cone 2 therewithin. The bush 8 is of such a length that its upper end 11 is disposed in the central cylindrical hole 5 of the spherical support 4. Placed between a lower end 12 of the out-of-balance weight 10 and a flange 13 of the bush 8 is a carrier ring 14. Provided in the bottom portion of the shell 3 is an annular projection 15 serving to support the carrier ring 14 of the bush 8. The diameter and height of the carrier ring 14 are such as to permit the bush 8, when tilted, to rest simultaneously upon the wall 16 of the cylindrical hole 5 and upon the annular projection 15 of the bottom portion of the shell 3. The projection 15 (FIG. 3) may also be fashioned as a taper washer 17 with its inner surface 18 facing the end 12 of the out-of-balance weight 10.

The device operates as follows. Upon the dismantling of the breaking cone 2, the bush 8 together with the out-of-balance weight 10 is tilted about the ball spindle and rests, with its upper end 11, upon the wall 16 of the cylindrical hole 5 of the spherical support 4. At the same time, the carrier ring 14 of the bush 8 rests upon the annular projection 15 of the bottom portion of the shell 3.

With the annular projection 15 shaped as the taper washer 17, the carrier ring 14 rests upon the inner tapered surface 18 of the washer 17.

Thus, the bush 8 is stopped against three points, namely the wall of the hole 5, the annular projection 15, and the ball spindle 7. The axis of the bush 8 therewith is but slightly tilted toward the axis of the shell 3. This enables the shaft 6 of the breaking cone 2 to be readily introduced into the crater or bore of the bush 8, when lowering the cone 2 by means of a crane on the spherical support 4.

The device for mounting the breaking cone of an inertia crusher simplifies the mounting of the breaking cone, as no subsidiary mechanisms and means associated therewith need be employed to mount it; reduces the labor consumption of the assembling works when mounting the breaking cone; and cuts down lost time when mounting the breaking cone.

The preferred embodiments of the present invention are not to be considered as limiting the scope of the invention. Various modifications dependent on the design of the ball spindle, out-of-balance weight, and shell may all be made without departing from the scope of the invention.

We claim:

1. An inertia cone crusher having a crushing bowl and a breaking cone provided with a shaft and fitted within the crushing bowl to provide a cavity therebetween for crushing a material, comprising:

a shell;

a spherical support having a central cylindrical hole receives said shaft of said breaking cone and is mounted in the top portion of said shell;

a ball spindle mounted in the bottom portion of said shell;

a bush having a bore is interconnected with said ball spindle and said bore is intended to receive said shaft of said breaking cone, the bush is of such a length that its upper end is sufficiently disposed within the central cylindrical hole of said spherical support so that said bush rests, when tilted during removal of said breaking cone, upon the inner wall of the central cylindrical hole of said spherical support;

an out-of-balance weight mounted on the outer surfaces of said bush; and an annular projection in the bottom portion of said shell serving as a support for said out-of-balance weight when said bush rests upon the wall of the central cylindrical hole of said spherical support.

2. An inertia cone crusher as claimed in claim 1, wherein said annular projection is in the form of a taper washer with its inner tapered surface facing said out-of-balance weight.

3. An inertia cone crusher as claimed in claim 1, including a carrier ring which serves as part of said bush, and said carrier ring resting atop said annular projection.

4. An inertia cone crusher as claimed in claim 1, wherein said annular projections forms an integral part of the bottom portion of said shell.

* * * * *